US007175106B2

(12) United States Patent
Román

(10) Patent No.: US 7,175,106 B2
(45) Date of Patent: Feb. 13, 2007

(54) PAINT STRIPER AND METHODS OF CONSTRUCTION

(76) Inventor: Kendyl A. Román, 730 Bantry Ct., Sunnyvale, CA (US) 94087-3402

( * ) Notice: Subject to any disclaimer, the term of this patent is extended or adjusted under 35 U.S.C. 154(b) by 385 days.

(21) Appl. No.: 10/104,961

(22) Filed: Mar. 23, 2002

(65) Prior Publication Data

US 2002/0175221 A1 Nov. 28, 2002

Related U.S. Application Data

(60) Provisional application No. 60/288,612, filed on May 4, 2001, provisional application No. 60/278,620, filed on Mar. 25, 2001.

(51) Int. Cl.
*B05B 1/28* (2006.01)

(52) U.S. Cl. ..... 239/155; 239/150; 222/162; 118/305

(58) Field of Classification Search ..... 269/754, 269/150, 151, 155–158; 222/616, 174, 402.13–402.15; 118/305; 248/146, 310, 311.2
See application file for complete search history.

(56) References Cited

U.S. PATENT DOCUMENTS 2,818,299 A * 12/1957 Payne ..... 239/158
3,007,645 A * 11/1961 Little ..... 239/150
3,485,206 A * 12/1969 Smrt ..... 118/305
3,698,675 A * 10/1972 Lerew et al. ..... 248/311.2
3,796,353 A * 3/1974 Smrt ..... 222/612
3,871,557 A * 3/1975 Smrt ..... 222/162
4,099,482 A * 7/1978 Smrt ..... 118/712
4,126,273 A * 11/1978 Smrt ..... 239/579
4,262,821 A * 4/1981 Smrt ..... 222/162
4,545,531 A * 10/1985 Williams ..... 239/150
4,599,968 A * 7/1986 Ryder et al. ..... 118/305
4,641,780 A * 2/1987 Smrt ..... 239/150
4,895,304 A * 1/1990 Smrt ..... 239/150
4,964,104 A * 10/1990 Capurka ..... 367/99
4,964,600 A * 10/1990 Lee ..... 248/146
5,148,988 A * 9/1992 Smrt ..... 239/150
5,287,998 A * 2/1994 Smrt ..... 222/402.1
5,411,184 A * 5/1995 Smrt ..... 222/402.13
5,518,148 A * 5/1996 Smrt ..... 222/174
5,749,522 A * 5/1998 Smrt ..... 239/71
6,102,305 A * 8/2000 Chapman et al. ..... 239/150
6,390,336 B1 * 5/2002 Orozco ..... 222/162
6,435,129 B1 * 8/2002 McDonald et al. ..... 116/211

FOREIGN PATENT DOCUMENTS

EP 0178065 * 4/1986 ..... 239/754
GB 0927986 * 6/1963 ..... 239/754

* cited by examiner

*Primary Examiner*—Patrick Brinson

(57) ABSTRACT

A series of improved paint stripers and methods for their construction, the use of lightweight, inexpensive, readily available construction materials, and specialized nozzles and actuators.

16 Claims, 20 Drawing Sheets

Prior Art

PAINT STRIPER AND METHODS OF CONSTRUCTION

RELATED APPLICATIONS

This application claims a priority filing date based on Provisional Patent Application Ser. No. 60/278,620, filed 2001 Mar. 25, entitled "PAINT STRIPER", the specifications of which are incorporated herein by reference. This application also claims a priorty filing date based on Provisional Patent Application Ser. No. 60/288,612, filed 2001 May 4, entitled "PAINT STRIPER AND METHODS OF CONSTRUCTION" the specifications of which are incorporated herein by reference. Any provisional claims are specifically excluded from this application.

BACKGROUND

1. Field of the Invention

This invention relates to applying a liquid to a surface along a desired path.

2. Description of the Prior Art

There is often a need to paint various types of surfaces such as parking lots, athletic fields and the like. Various methods have been employed to accomplish these tasks.

In the past, lime or chalk lines were used to mark the boundaries on athletic fields used for playing such sports as baseball, soccer, rugby or football. The use of such lining techniques has several disadvantages such as having to frequently re-lime or re-chalk the fields due to bad weather conditions or players erasing the marks by sliding and running over them. One remedy is to use paint instead of chalk to more effectively mark playing fields.

There are a number of field marking machines that now utilize paint. Examples are the Tru Mark Athletic Field Marker, Line King Athletic Field Marker, and Allstate Athletic's Supply's Jiffy Stripers. However, these machines have several disadvantages namely, their high prices (some models over $1000). Other disadvantages are that these field markers often are heavy, bulky, and difficult to store or transport.

Motorized paint stripers, like Neuling's U.S. Pat. No. 5,718,534, have other disadvantages. They require the use of fossil fuels, which are harmful to the environment. With other motorized ride-on stripers, the operator's view of the paint stripe is limited. Another disadvantage of the existing paint stripers are that they are made from specialized parts that require costly design and tooling and are not readily available.

SUMMARY OF THE INVENTION

Accordingly, it is a purpose of the present invention to provide an improved paint striper that can be used to effectively paint lines on a number of surfaces such as an athletic field.

Objects and Advantages

Accordingly, beside the objects and advantages described above, some additional objects and advantages of the present invention are:

1. To provide an inexpensive paint striper.
2. To provide an inexpensive way to mark athletic fields.
3. To provide a simpler way of making a paint striper.
4. To provide a collapsible paint striper.
5. To provide an easy way to store paint striper.
6. To provide an easy way to transport paint striper.

7. To provide a lightweight paint striper.
8. To provide various, simple models of paint stripers that can be selected based on available funds and special needs.
9. To provide a dispenser that will hold a container of liquid while dispensing so that the user does not have to stress their back by bending over.
10. To provide a paint striper that does not require the use of fossil fuels and is therefore more environmentally friendly.
11. To provide a paint striper that allows clear visibility of the striping process.
12. To provide an easy way to turn the paint "on" and "off".
13. To provide a simple way to manufacture paint stripers.
14. To provide an inexpensive way to manufacture paint stripers.
15. To provide an ideal paint striper for people, groups of people, and organizations, such as athletic clubs, schools and churches, who prefer a low maintenance and low cost paint striper.
16. To provide a paint striper that could be sold in kits to be assembled by the purchaser.
17. To provide a paint striper made of PVC pipe and or other types of rods, pipes, and tubing that are plastic, metal etc. and which are inexpensive and readily available.
18. To provide a simple, no hassle means of triggering the spray nozzle.
19. To provide a paint striper with superior line tracking.

These and other features and advantages of the present invention will become apparent upon consideration of the following specification, claims, and drawings.

DRAWING FIGURES

In the drawings, closely related figures have the same number but different alphabetic suffixes.

Figure 1:
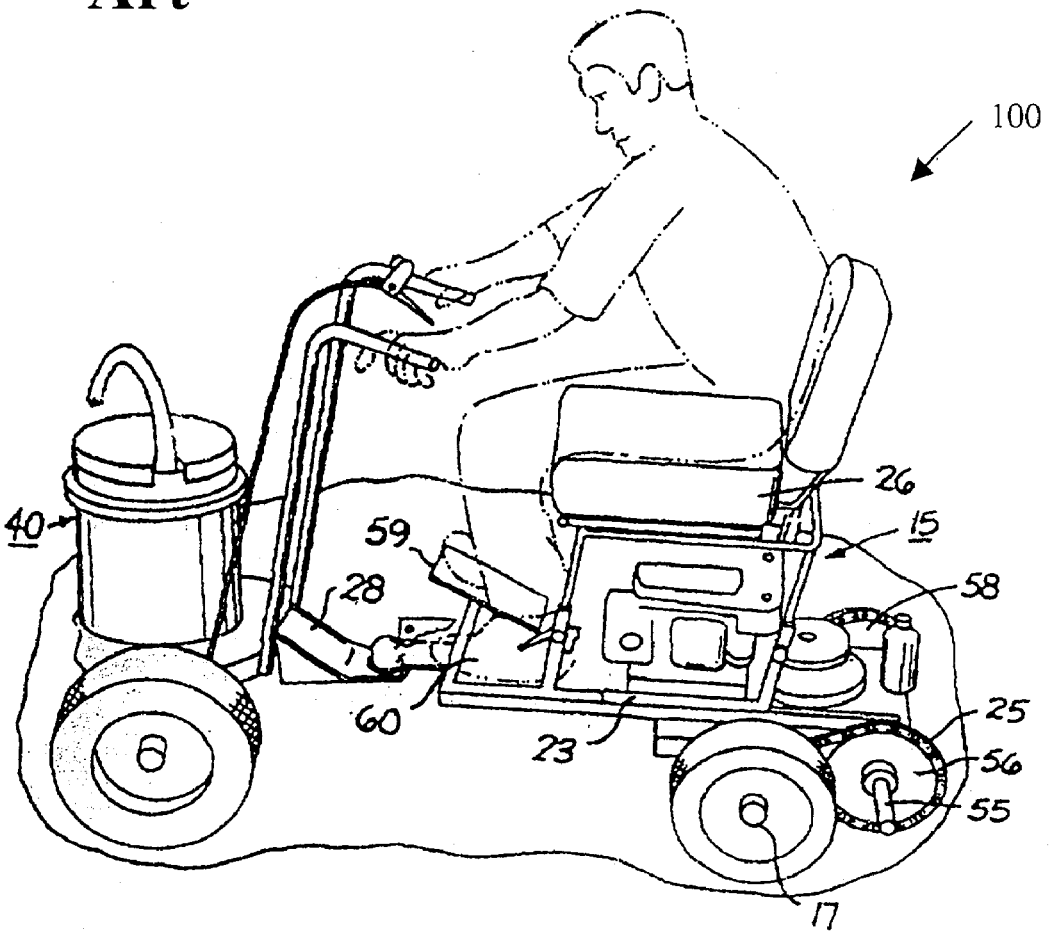
FIG. 1 shows a prior art paint striper.

| REFERENCE NUMERALS IN DRAWINGS | |
|---|---|
| 100 | prior art striper |
| 200 | shortened container holder |
| 202 | container |
| 204 | spray |
| 206 | container holder with cutouts |
| 210 | access cutout |
| 212 | handle cutout |
| 220 | container holder |
| 230 | extension |
| 300 | wheel |
| 400 | axle |
| 410 | washer |
| 420 | second washer |
| 430 | axle nut |
| 500 | handle |
| 600 | elbow |
| 610 | handle grip |
| 620 | shifter |
| 630 | cable |
| 700 | first wheel |
| 710 | second wheel |
| 720 | two wheel axle |
| 730 | two wheel axle-deflector |
| 740 | extension two wheel axle |
| 800 | first shaft |
| 810 | second shaft |
| 820 | 3 way connector |
| 830 | third shaft |
| 840 | fourth shaft |
| 850 | rear wheel |
| 860 | second axle |
| 1000 | fourth wheel |
| 1020 | fifth shaft |
| 1030 | first spare container |
| 1100 | first actuator |
| 1102 | triangular receptor |
| 1110 | second actuator |
| 1112 | rectangular receptor |
| 1120 | third actuator |
| 1122 | hex receptor |
| 1130 | fourth actuator |
| 1132 | rounded receptor |
| 1140 | fifth actuator |
| 1142 | rounded rectangular receptor |
| 1150 | sliding actuator |
| 1152 | receptor |
| 1200 | squeeze trigger |
| 1210 | squeeze shaft |
| 1220 | spring |
| 1240 | lever fulcrum |
| 1250 | lever trigger |
| 1260 | lever shaft |
| 1270 | support |
| 1280 | container actuator |
| 1290 | container clamp |
| 1300 | nut |
| 1310 | first stay |
| 1320 | second stay |
| 1330 | long container bolt |
| 1340 | container bolt |
| 1400 | wire bolt |
| 1410 | wire bolt nut |
| 1420 | cable wire |
| 1430 | wire hole |
| 1440 | wire bolt hole |
| 1500 | first pad |
| 1510 | second pad |
| 1530 | ring |
| 1540 | slotted container holder |
| 1550 | first opening |
| 1560 | second opening |
| 1700 | shaped nozzle |
| 1705 | spray tube receptor |

-continued

| REFERENCE NUMERALS IN DRAWINGS | |
|---|---|
| 1707 | spray nozzle tip |
| 1710 | stayed nozzle |
| 1712 | nozzle stop |
| 1720 | beveled block nozzle |
| 1725 | beveled edge |
| 1730 | notched nozzle |
| 1735 | notch |
| 1740 | deflector |
| 1745 | rectangular notch |
| 1750 | rectangular deflector |
| 1760 | rectangular notched nozzle |
| 1800 | first spare container |
| 1810 | first lid |
| 1820 | second lid |
| 1830 | second spare container |
| 1835 | connector |
| 1840 | first container fastener |
| 1850 | second container fastener |
| 1900 | acute connector |
| 2000 | ninety degree connector |
| 2010 | forty-five degree connector |
| 2020 | connecting shaft |

SPECIAL DEFINITIONS actuator—a device for opening and closing a valve or initiating an action.

container fastener—a device for temporarily holding containers in place including straps, clips, latches, ties, snaps, hooks and loops, or similar devices.

shaft—a supporting member in construction including any solid or hollow, round or rectangular bar, beam, pole, rod, spar, or tube composed of wood, plastic, metal, or composite material.

trigger—a movable part by which a mechanism is actuated or something that initiates a process or reaction.

wheel—a solid disk or rigid circular ring connected to a hub, designed to turn around an axle passed through the center.

DESCRIPTION OF PRIOR ART

FIG. 1 shows a prior art striper 100. The present invention has numerous advantages over the prior art stripers as explained above.

DESCRIPTION OF THE INVENTION

The present invention comprises: an improved paint striper, the use of low cost, lightweight, readily available construction materials and methods of manufacturing improved paint stripers that can be used to effectively paint lines on a number of surfaces such as an athletic field.

FIG. 2A

Figure 2A:
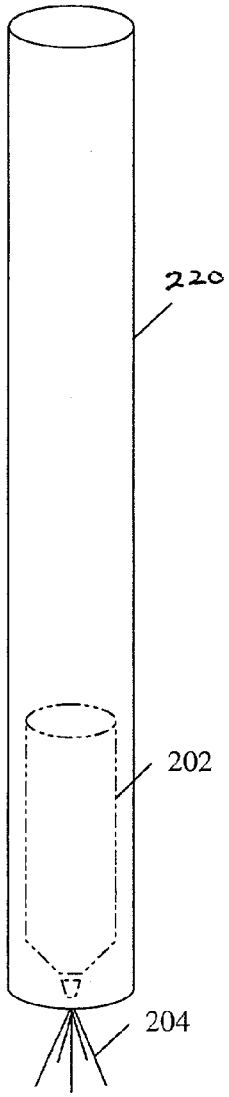
FIGS. 2A through 2C show simple paint stripers.

FIG. 2A illustrates a container holder 220, a hollow shaft, made to carry a container 202 of fluid, such as a spray paint can, so that when the container 202 is inserted into the container holder 220, a spray 204 is dispensed. Good results have been obtained by making the container holder 220 of 3" PVC pipe. As will be shown later, the inside of the holder can be lined with padding so that the container 202 fits snuggly into the container holder 220. In this embodiment, the container holder 220 normally extends in length from the operator's hand to the surface so that the operator can dispense the fluid to the surface without having to bend over or otherwise cause stress or fatigue.

FIG. 2B

Figure 2B:
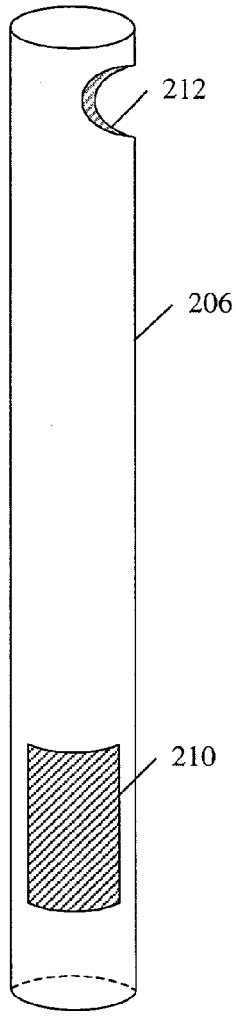

FIG. 2B illustrates an alternate form of the container holder 220, container holder with cutouts 206, having two cutout features: an access cutout 210 for insertion of the container 202 and a handle cutout 212 for carrying the paint striper. These cutouts can be made by cutting sections out of the hollow shaft. In this embodiment the container holder 220 normally extends in length from the operator's hand to the surface so that the operator can dispense the fluid to the surface without having to bend over or otherwise cause stress or fatigue.

FIG. 2C

Figure 2C:
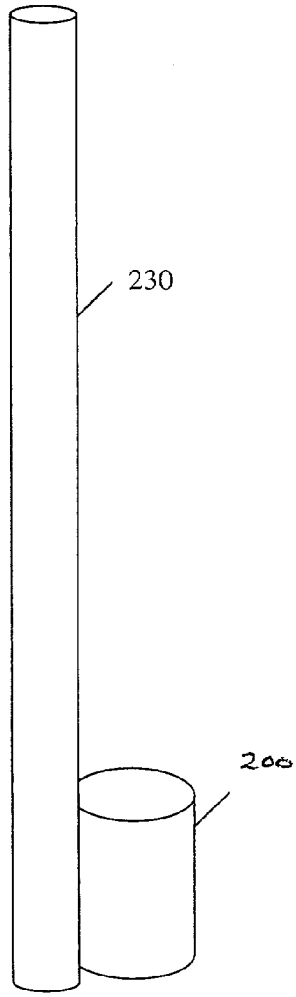

FIG. 2C illustrates another basic form of a paint striper comprising a container holder 200 comprising an extension 230 connected to a shortened container holder 200. The extension 230 is a shaft (or, as will be shown later, a combination of shafts and connectors or handles). Good results have been obtained by utilizing PVC pipe for the extension. This assembly allows paint lining, or other fluid dispensing tasks done with a wand like apparatus. This model would be ideal for touch up jobs, painting hard to reach corners and the like.

FIG. 3

Figure 3:
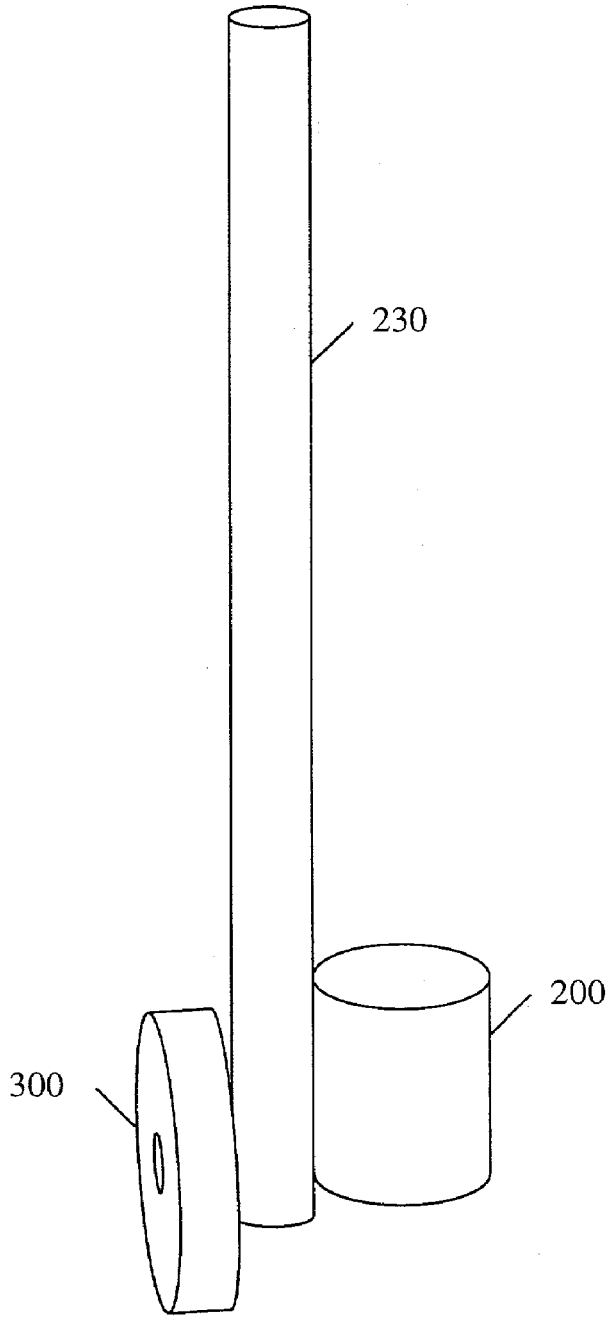
FIG. 3 shows a paint striper with a single wheel.

FIG. 3 illustrates the embodiment shown in FIG. 2C in combination with a wheel 300. The extension 230 is connected to the container holder 220 (in this case a shortened container holder 200) and to the wheel 300 by a bolt that passes through them. The wheel 300 could be a simple wooden or plastic disc or any number of more complicated wheel forms and compositions. Good results have been obtained by using a wheel measuring about 6.5" in diameter. The addition of the wheel 300 provides for less user fatigue, straighter tracking, and more even separation between the spray 204 and the surface.

FIG. 4

Figure 4:
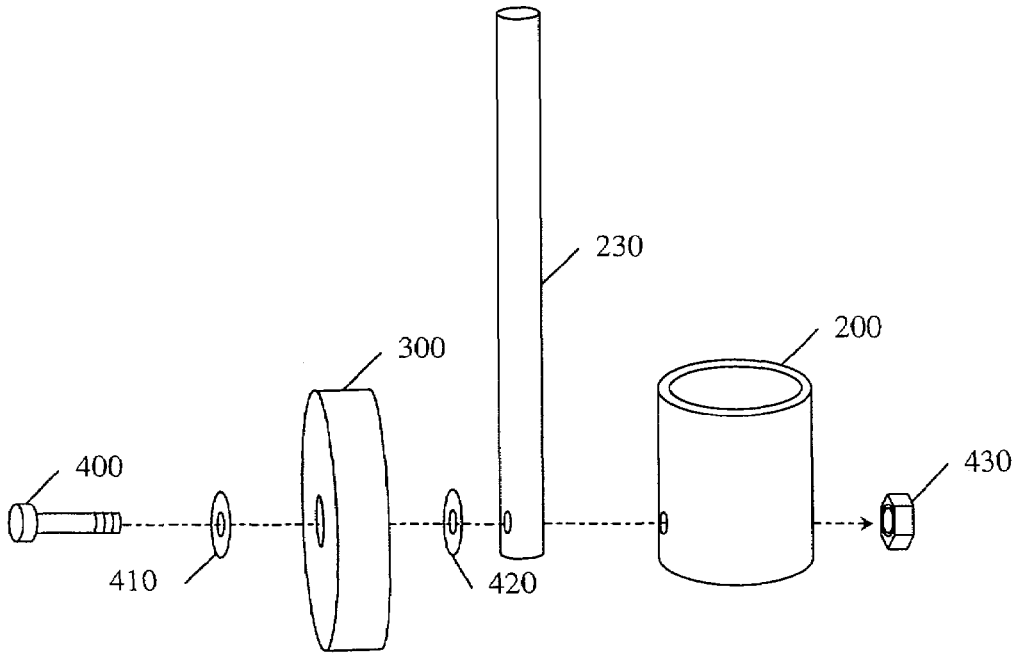
FIG. 4 shows an exploded view of a paint striper with a single wheel.

FIG. 4 shows an exploded view of the embodiment shown in FIG. 3. In this example, an axle 400 is composed of a standard bolt, nut, and washers. The axle 400 goes through a washer 410, then passes through the wheel 300, optionally through a second washer 420, and then through the extension 230 to the shortened container holder 200 and is fastened by an axle nut 430. The axle 400 optionally can pass all the way through the shortened container holder 200 (as shown) and act as an actuator of the spray nozzle (as shown in FIG. 17E) or the axle nut 430 can be attached inside the shortened container holder 200. Either way the axle 400 and its attached axle nut 430 keep the container 202 from sliding out of the shortened container holder 200. Any number of equivalent axle structures and methods of forming an axle are known in the art. It is anticipated by the present invention that any equivalent axle structure could be substituted. It is also anticipated by the present invention that any functionally equivalent means of attachment could be used, including but not limited to glue, hook and notch, screws, rivots, wires, tie wraps, and the like.

FIG. 5

Figure 5:
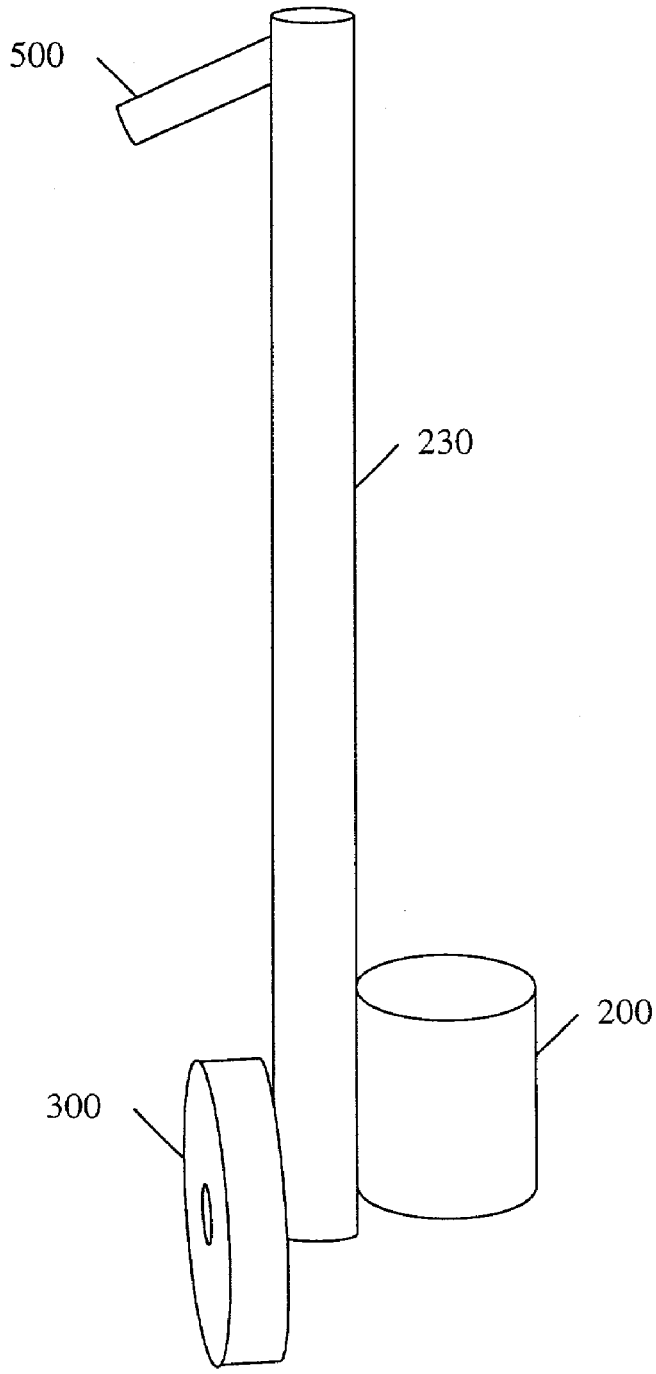
FIG. 5 shows a paint striper with a handle.

FIG. 5 shows the addition of a handle 500 to a paint striper. The handle 500 makes the striper easier to use, increases comfort, and provides a means of steering the device to maintain the desired track against the surface.

FIG. 6

Figure 6:
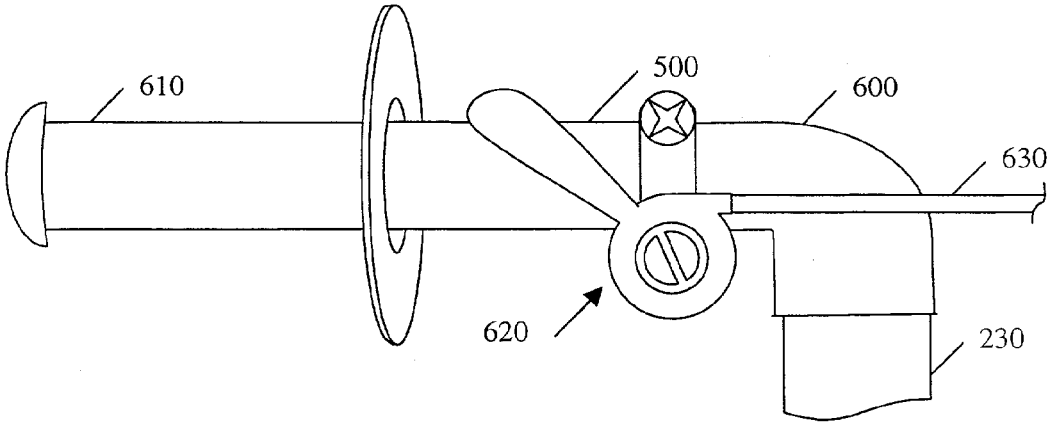
FIG. 6 shows a handle with grip and trigger.

FIG. 6 shows details of an embodiment where the handle 500 is connected to the extension 230 with an elbow 600. FIG. 6 also shows an optional handle grip 610. FIG. 6 also shows a trigger mechanism, in this case a shifter 620. The shifter 620 connects to a cable 630. Good results have been obtained by utilizing a standard 6" long ½ nipple as the handle 500, a standard bicycle handle grip, a 1×½ PVC elbow as elbow 600, and a standard cable shifter and cable.

FIG. 7

Figure 7A:
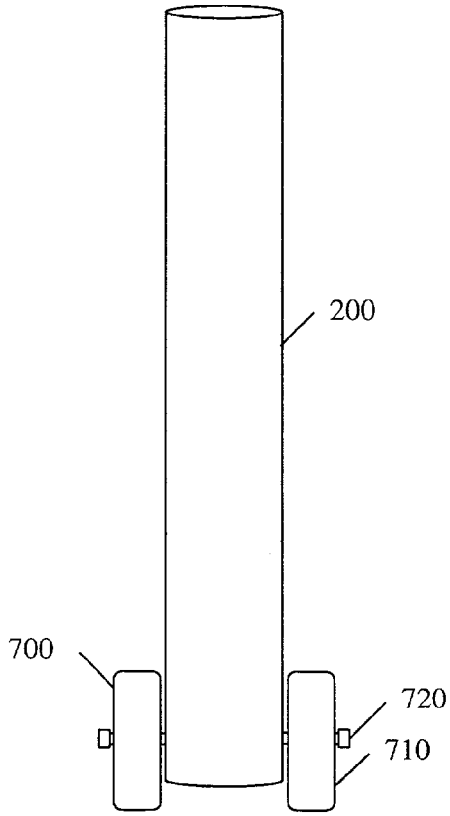
FIGS. 7A through 7D show paint stripers with one or two wheels on one axle.
Figure 7B:
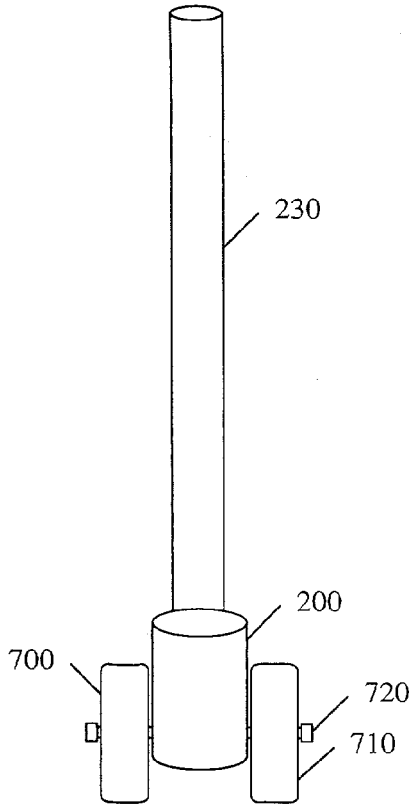
Figure 7C:
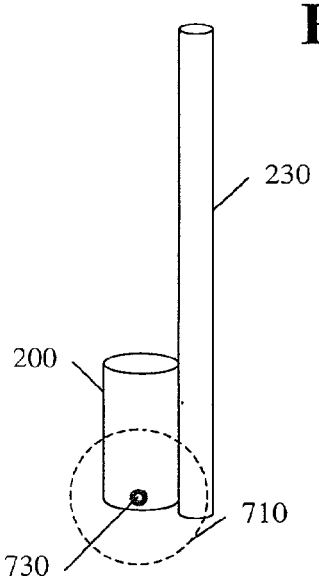
Figure 7D:
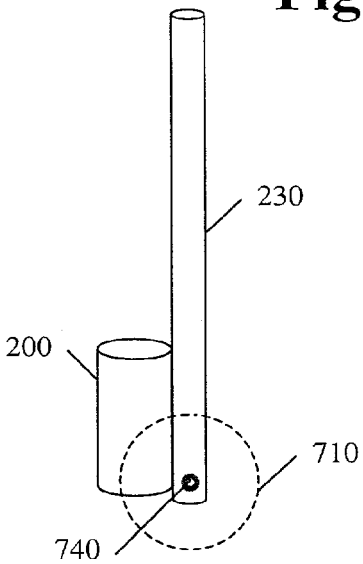

FIGS. 7A and 7B illustrate a paint striper with two wheels on one axle: a first wheel 700 and a second wheel 710 connected to a two wheel axle 720. Assembly hardware (bolts, washers, and nuts or their equivalents) is similar to that shown in FIG. 4. Depending on the trigger mechanism, the axle can pass through either the shortened container holder 200, as shown in FIG. 7C (where the axle 720 is referred to as a two wheel axle-deflector 730), or the extension 230 as shown in FIG. 7D (where the axle 720 is referred to as an extension two wheel axle 740). The two wheel axle-deflector 730 functionally doubles as an axle 400 and a nozzle deflector.

FIG. 8

Figure 8:
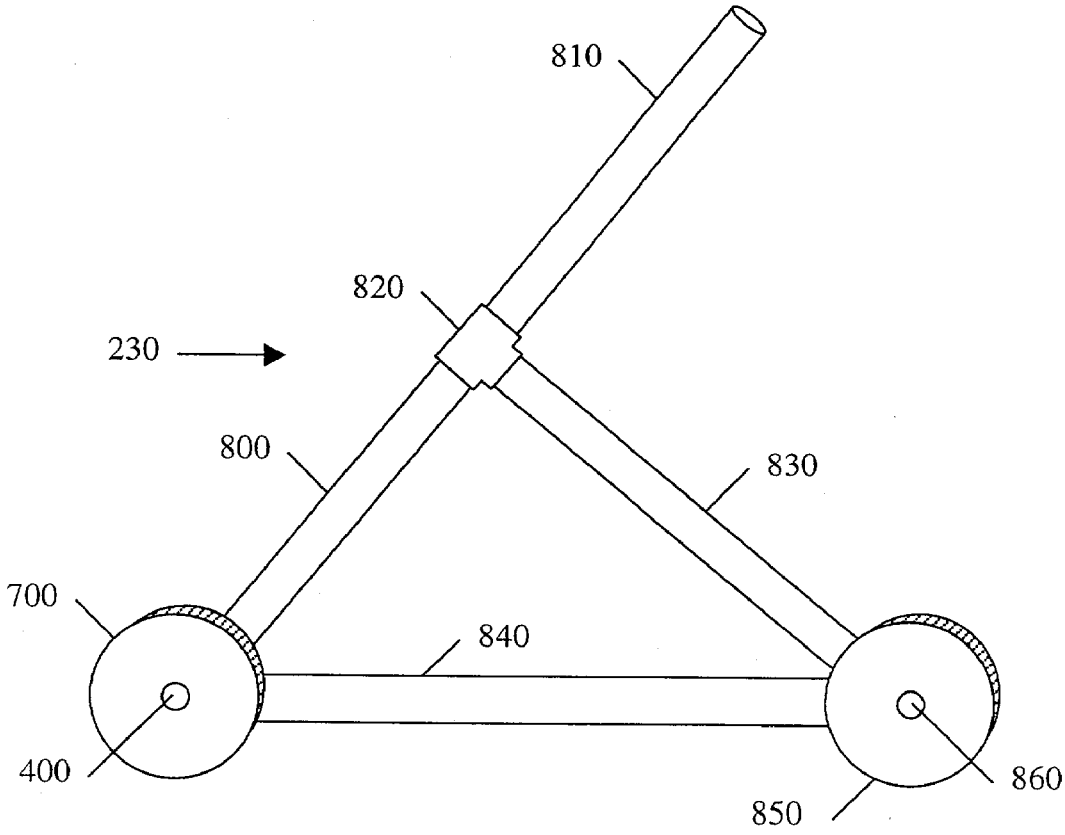
FIG. 8 shows a paint striper with two wheels, one on each axle.

FIG. 8 illustrates an alternate embodiment of a paint striper with two wheels on separate axles. The first wheel 700 is connected to the extension 230 in a similar manner as shown in FIG. 4 on axle 400. A rear wheel 850 is connected to a second axle 860. The extension 230 comprises a first shaft 800, connected to second shaft 810 with a 3 way connector 820. A third shaft 830 connects between the 3 way connector 820 and the second axle 860. A fourth shaft 840 stabilizes the structure by connecting between the two axles, 400 and 860, respectively. Optional handle or trigger assemblies (such as shown in FIG. 6 and FIGS. 12A through 12D) are not shown but could be added to this wheel structure.

FIG. 9

Figure 9:
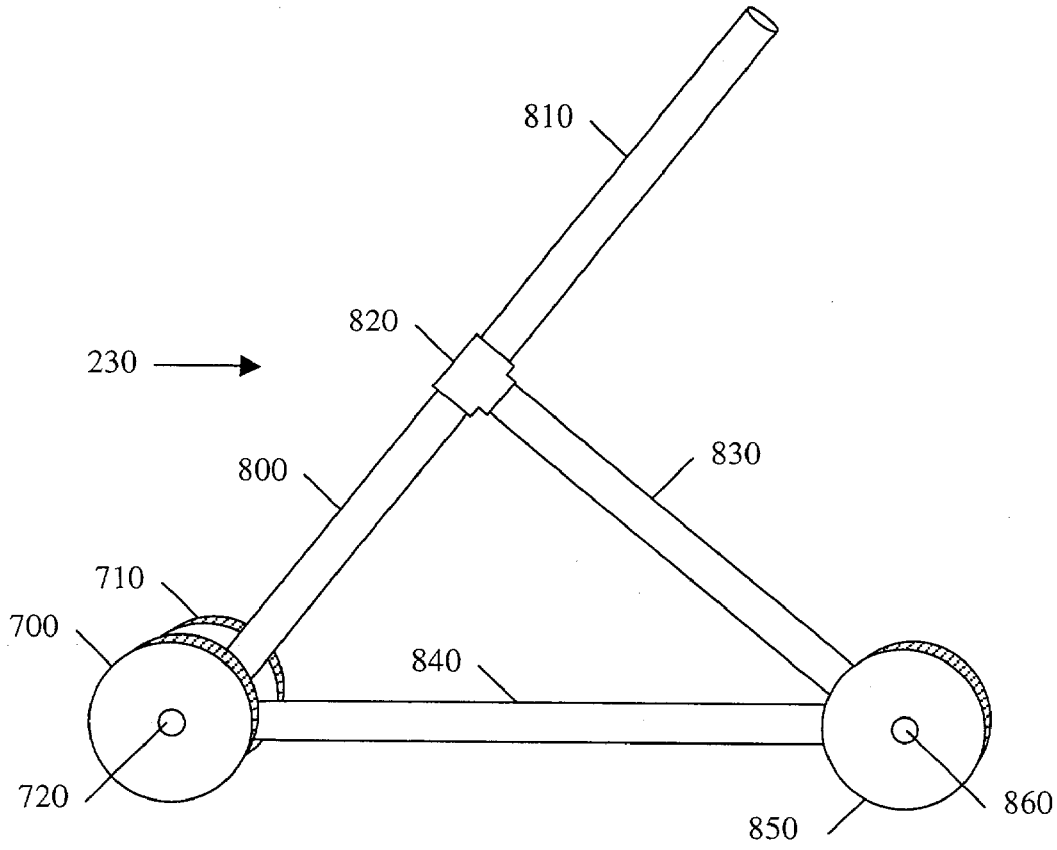
FIG. 9 shows a paint striper with three wheels, two on one axle and one on the other.

FIG. 9 illustrates an alternate embodiment of a paint striper with three wheels on two separate axles. The first wheel 700 and second wheel 710 are connected to the extension 230 in a similar manner as shown in FIG. 7 on the two wheel axle 720. The rear wheel 850 is connected to the second axle 860. The extension 230 comprises the first shaft 800, connected to the second shaft 810 with the 3 way connector 820. A third shaft 830 connects between the 3 way connector 820 and the second axle 860. A fourth shaft 840 stabilizes the structure by connecting between the two axles, 720 and 860, respectively. An optional fifth shaft 1020 is parallel to the fourth shaft 840. Optional handle or trigger assemblies (such as shown in FIG. 6 and FIGS. 12A through 12D) are not shown but could be added to this wheel structure.

FIG. 10

Figure 10:
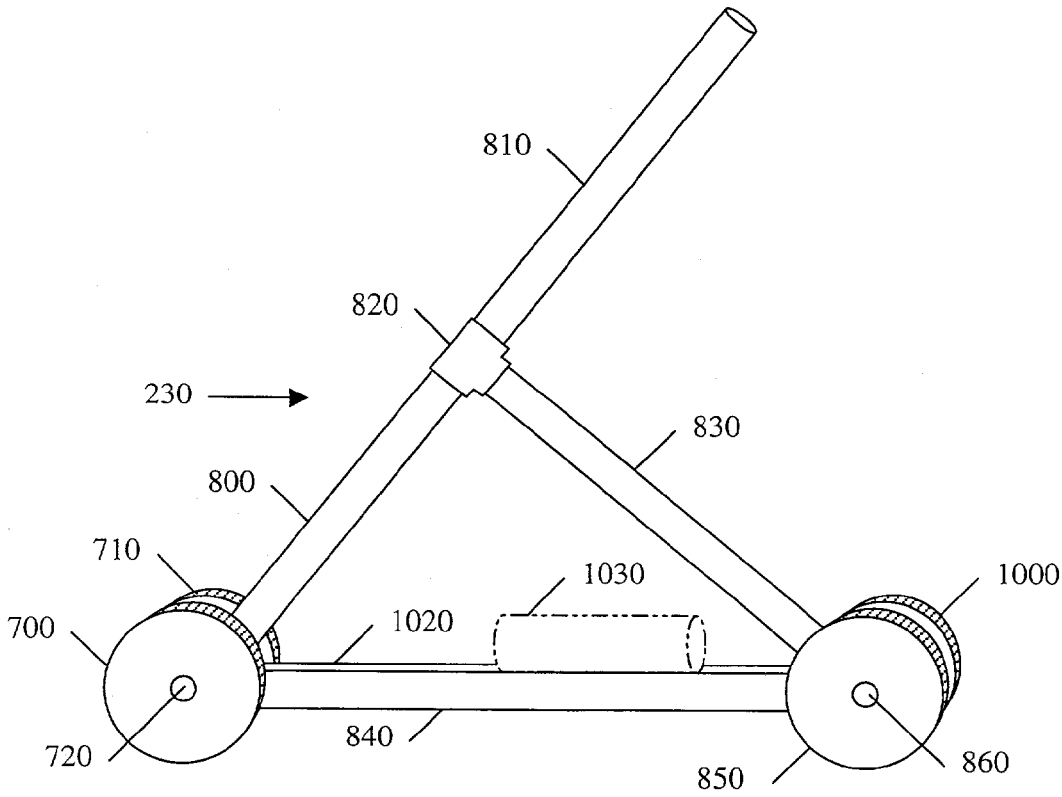
FIG. 10 shows a paint striper with four wheels, two on one axle and two on the other.

FIG. 10 illustrates an alternate embodiment of a paint striper with four wheels on two separate axles. The first wheel 700 and the second wheel 710 are connected to the extension 230 in a similar manner as shown in FIG. 7 on two wheel axle 720. The rear wheel 850 and a fourth wheel 1000 are connected to the second axle 860. The extension 230 comprises the first shaft 800, connected to the second shaft 810 with the 3 way connector 820. The third shaft 830 connects between the 3 way connector 820 and the second axle 860. The fourth shaft 840 stabilizes the structure by connecting between the two axles, 720 and 860, respectively. A first spare container 1030 is shown resting in between the fourth shaft 840 and the fifth shaft 1020. Often it takes more than one container 202 of paint to paint an entire field. This embodiment provides the added advantage of storing spare containers. Optional handle or trigger assemblies (such as shown in FIG. 6 and FIGS. 12A through 12D) are not shown but could be added to this wheel structure.

FIGS. 11A through 11G

FIGS. 11A through 11G show various embodiments and views of actuators. Each actuator shown is used to activate the valve on the container 202. Each actuator is designed with a hole, or receptor, that matches a spray nozzle so that the container 202 can be readily changed when empty. Good results have been found using a disc with the desired type of receptor hole cut in it.

Figure 11A:
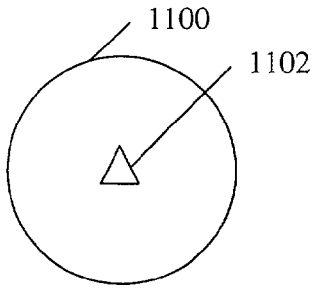
FIGS. 11A through 11G show various embodiments of actuators.

FIG. 11A shows a first actuator 1100 with a triangular receptor 1102.

Figure 11B:
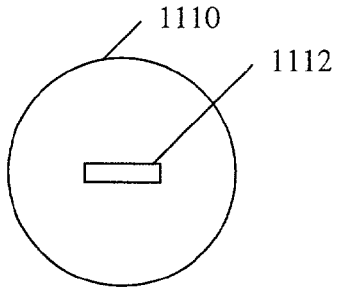

FIG. 11B shows a second actuator 1110 with a rectangular receptor 1112.

Figure 11C:
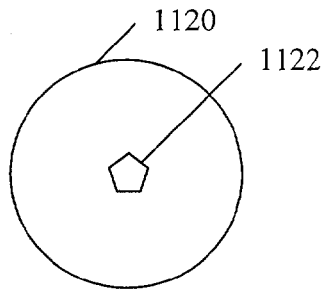

FIG. 11C shows a third actuator 1120 with a hex receptor 1122.

Figure 11D:
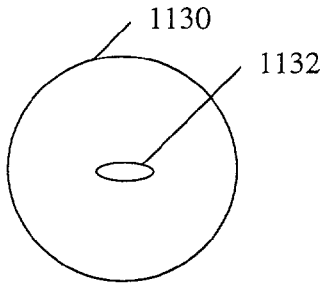

FIG. 11D shows a fourth actuator 1130 with a rounded receptor 1132.

Figure 11E:
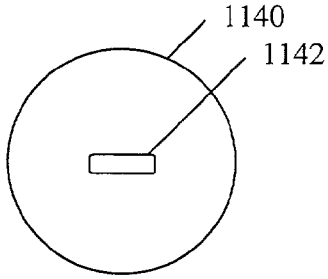

FIG. 11E shows a fifth actuator 1140 with a rounded rectangular receptor 1142.

Figure 11F:
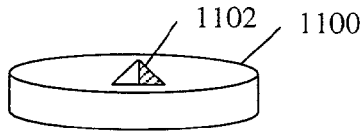

FIG. 11F shows a perspective view of the first actuator 1100.

Figure 11G:
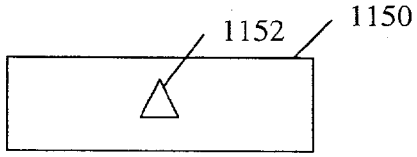
Figure 11H:
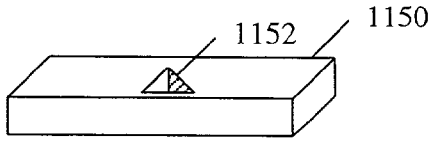

FIG. 11G shows a sliding actuator 1150 with a receptor 1152. Any receptor shape could be used with the sliding actuator.

FIG. 1H shows a perspective view of the sliding actuator 1150.

FIGS. 12A through 12E

FIGS. 12A through 12E show various details of trigger mechanisms. Three different trigger mechanisms are shown. Any of the three or any substantially similar trigger mechanisms could be used with the various embodiments of the present invention.

Figure 12A:
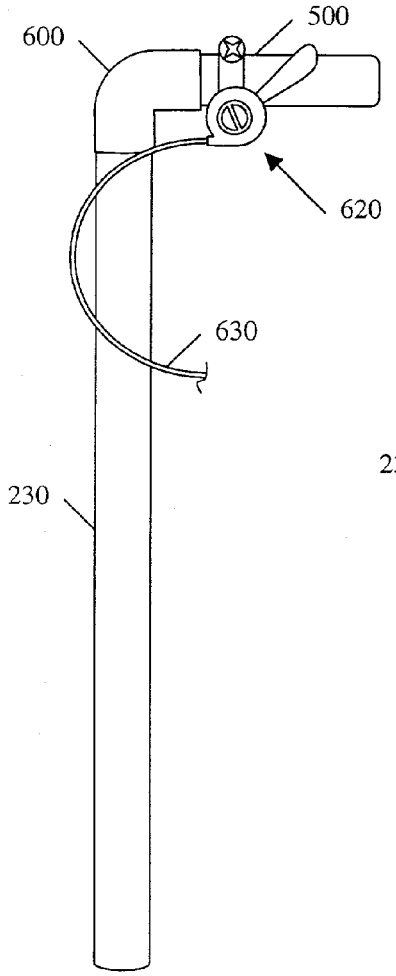
FIGS. 12A through 12E show various trigger mechanisms.

FIG. 12A shows the trigger mechanism as shown and explained regarding FIG. 6.

Figure 12B:
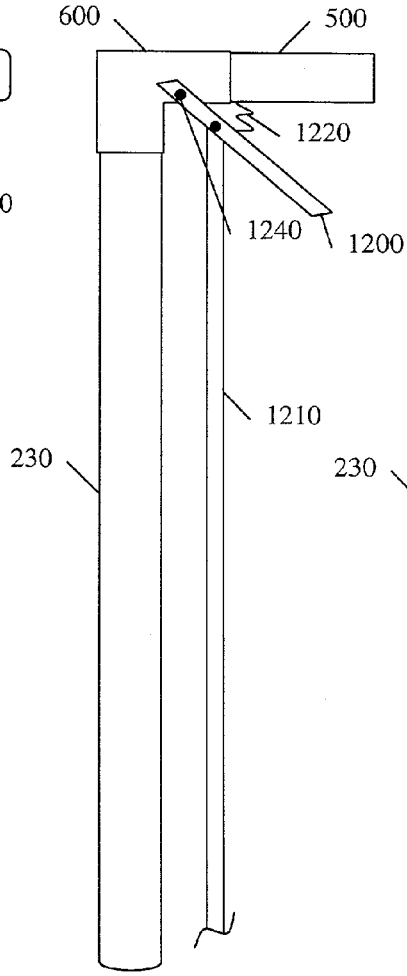

FIG. 12B shows a squeeze trigger mechanism comprising a squeeze trigger 1200 which moves a squeeze shaft 1210 to exert a triggering force on the actuator or the container 202 itself. The squeeze trigger 1200 can optionally be returned to a default position by a spring 1220. The triggering force could activate the spray. Alternatively, the default position could activate the spray and squeezing the trigger could deactivate the spray.

Figure 12C:
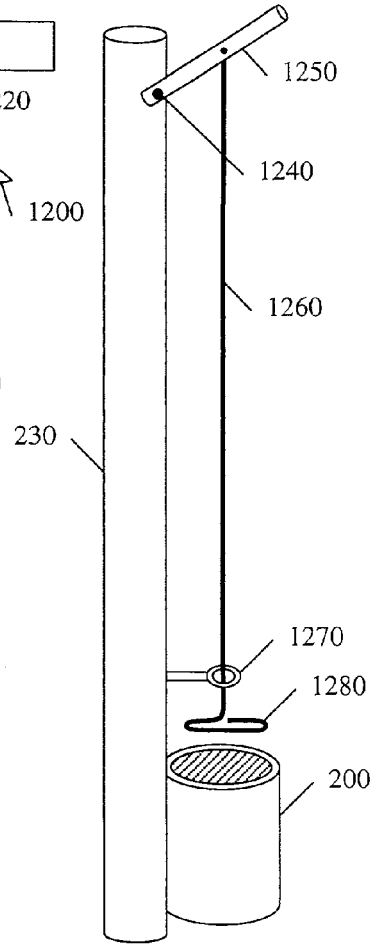

FIG. 12C shows a lever trigger mechanism comprising a lever trigger 1250 which turns on a lever fulcrum 1240 to move a lever shaft 1260 to exert a triggering force on the actuator or the container 202 itself. A support 1270 stabilizes the lever shaft 1260. A container actuator 1280 is shown as one way to activate the spray 204.

Figure 12D:
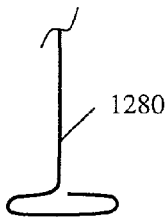

FIG. 12D shows the detail of the container actuator 1280 shown in FIG. 12C, which catches the edge, or pushes on the bottom, of the container 202 and lifts or lowers the container 202 to activate the spray 204.

Figure 12E:
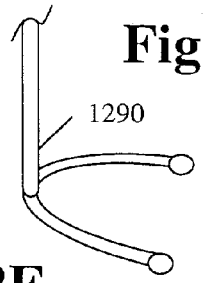

FIG. 12E shows an alternate container actuator, a container clamp 1290, which clamps onto the sides of the container 202.

Figure 13A:
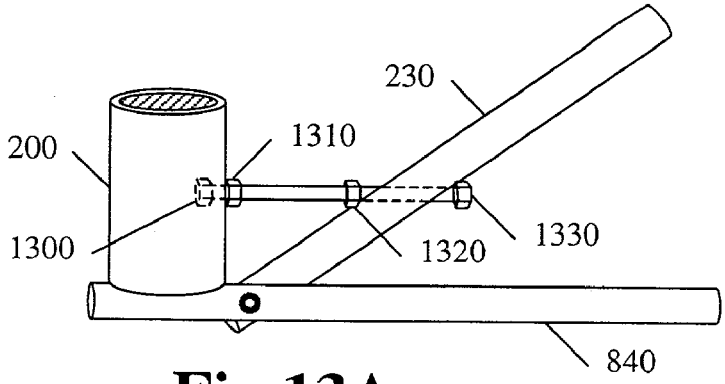
FIGS. 13A through 13C show various can holder mountings.
Figure 13B:
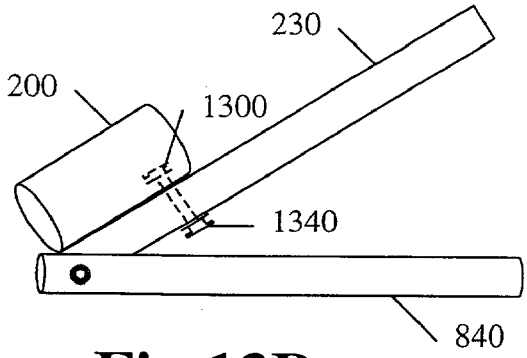
Figure 13C:
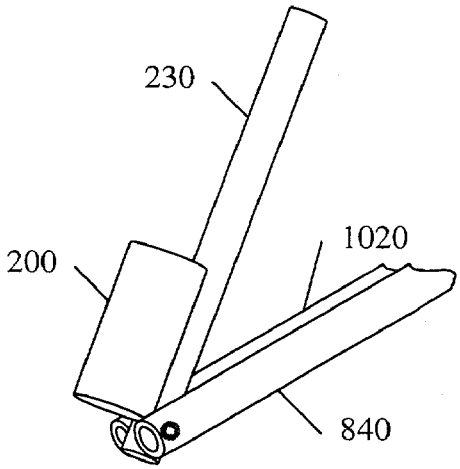

FIGS. 13A through 13C

FIGS. 13A through 13C show various can holder mountings. The angle of the shortened container holder 200 can be different than the angle of the extension 230 by using a nut 1300, a first stay 1310, a second stay 1320, and a long container bolt 1330. The stays (1310 and 1320) could be additional nuts or clips that attach to the container bolt 1330 to hold the desired angle.

FIG. 13B shows a configuration where the shortened container holder 200 is attached to the extension 230 via a container bolt 1340, a simpler version of the long container bolt 1330, and the nut 1300.

FIG. 13C shows a perspective view where the shortened container holder 200 is shown resting on the extended portions of the fourth shaft 840 and the fifth shaft 1020. This configuration stabilizes the shortened container holder 200 without needing more hardware than the container bolt 1330 and the nut 1300.

Figure 14A:
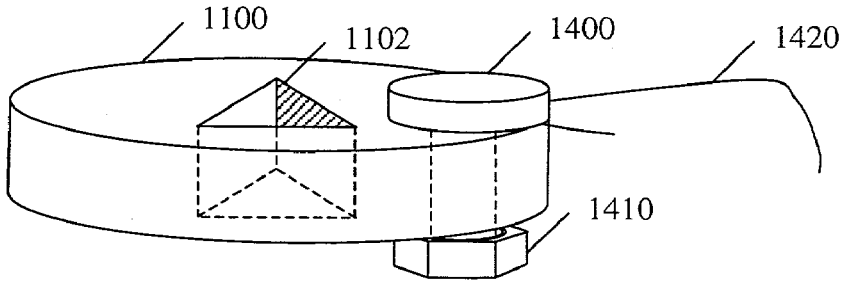
FIGS. 14A and 14B show various actuator wire attachments.
Figure 14B:
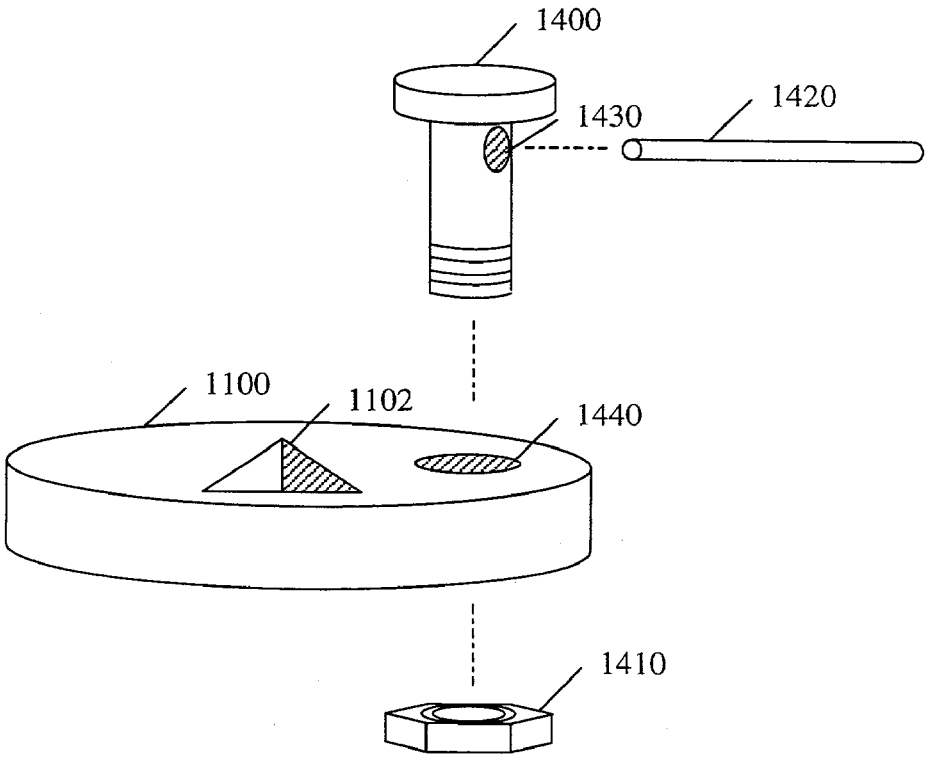

FIGS. 14A and 14B

FIGS. 14A and 14B show various actuator wire attachments. FIG. 14A shows a cable wire bolt 1420 (from cable 630) being fastened to the first actuator 1100 by wrapping it around a wire bolt 1400 which passes through the actuator 1100 and is held tight by a wire bolt nut 1410. FIG. 14B shows a variation where the wire bolt 1400 has a wire hole 1430. The cable wire 1420 passes through the wire hole 1430. FIG. 14B also shows a wire bolt hole 1440.

FIGS. 15A through 15D

Figure 15A:
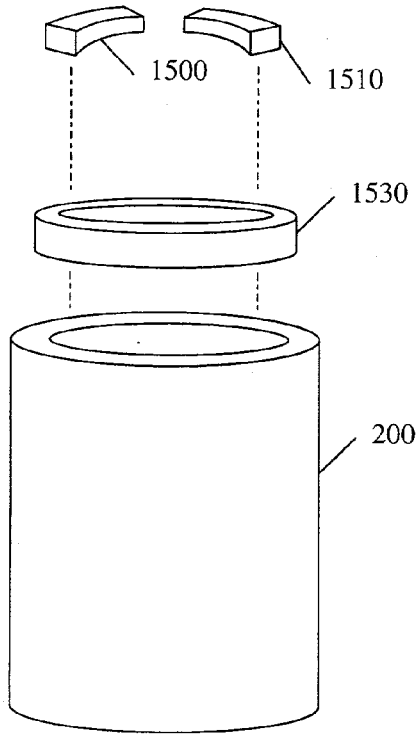
FIGS. 15A through 15D show various container holder configurations.
Figure 15B:
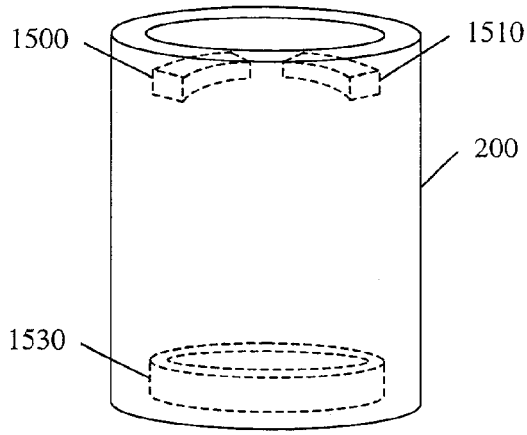

FIGS. 15A through 15D show various shortened container holder configurations. FIG. 15A is an exploded view. A first pad 1500 and a second pad 1510 attach inside the shortened container holder 200 to stabilize the container 202. A ring 1530 stops the container 202 from passing through the shortened container holder 200. Good results have been found using ½ inch foam rubber for the pads (1500 and 1510) and the ring 1530. FIG. 15B shows the pads (1500 and 1510) and the ring 1530 in place inside the shortened container holder 200.

Figure 15C:
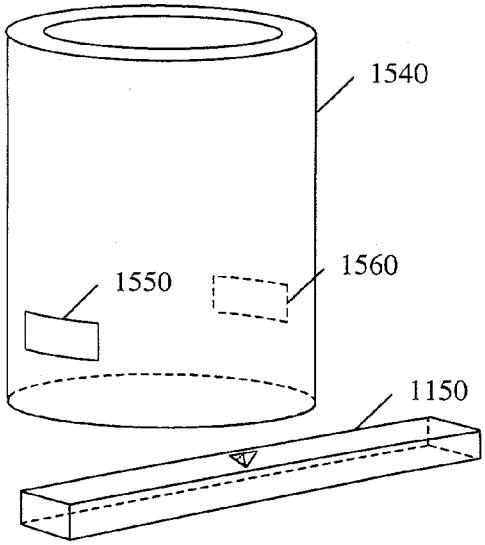
Figure 15D:
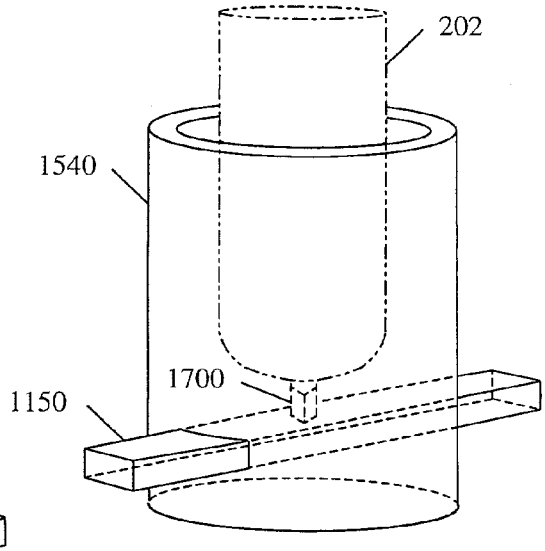

FIG. 15C shows a variation of the container holder 220. In this embodiment the container holder 220 is slotted, a slotted container holder 1540. A first opening 1550 and a second opening 1560 allow the sliding actuator 1150 to pass through the slotted container holder 1540. FIG. 15D shows the assembly with the sliding actuator 1150 holding the container 202 inside the container holder 220 and actuating the spray 204.

FIG. 16

Figure 16:
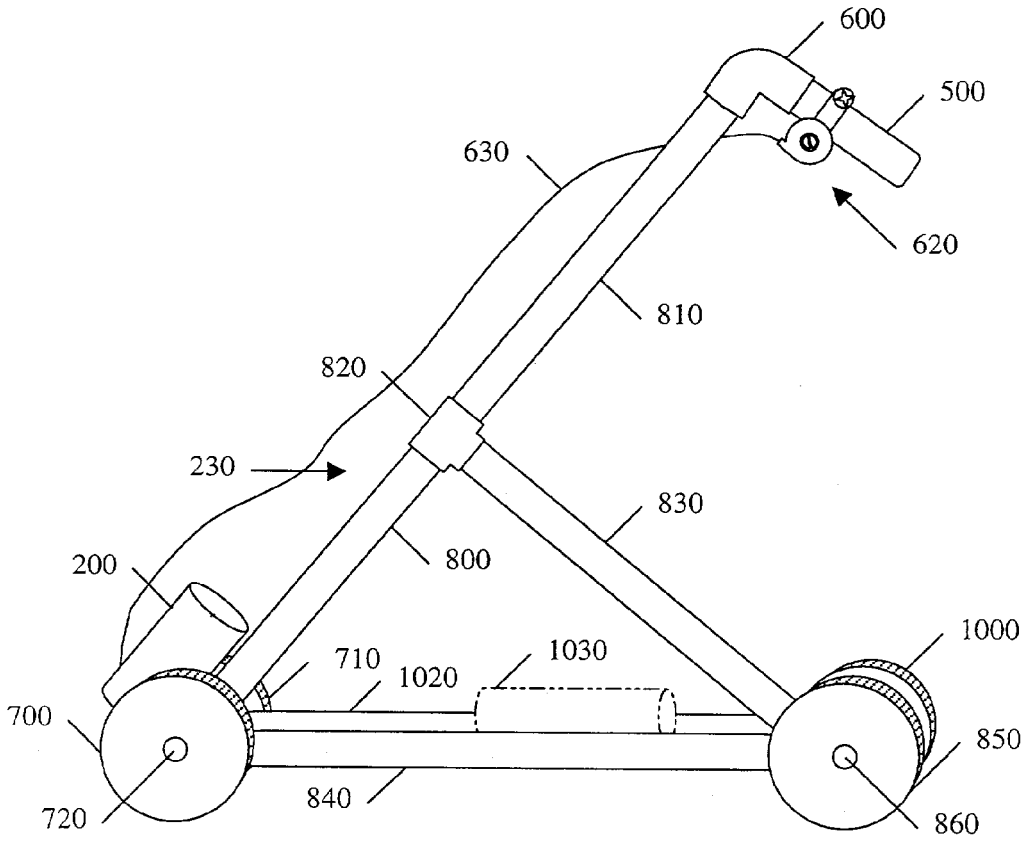
FIG. 16 shows a preferred paint striper.

FIG. 16 shows a embodiment of the paint striper invention with many of the optional features described above. In this embodiment the cable wire 1420 of the cable 630 is connected to an actuator such as the first actuator 1100 as shown in FIG. 14A.

FIGS. 17A through 17F

Figure 17A:
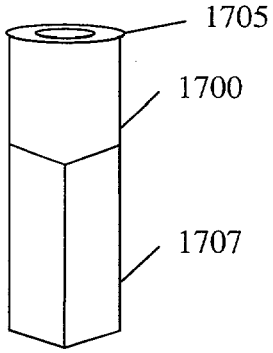
FIGS. 17A through 17G show various spray nozzles.
Figure 17B:
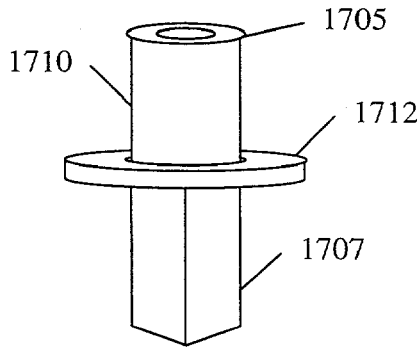
Figure 17C:
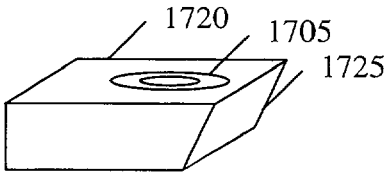
Figure 17D:
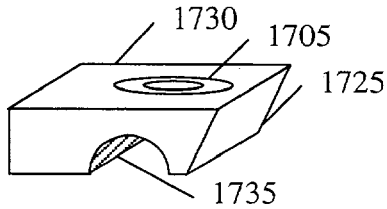
Figure 17E:
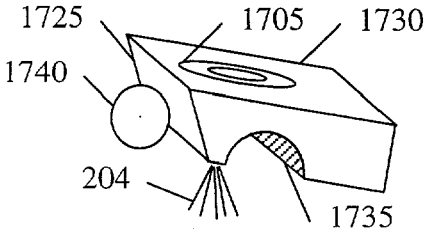

FIGS. 17A through 17H show various spray nozzles and their activation. FIG. 17A shows a shaped nozzle 1700. It is shaped to match the receptor of the actuator. It comprises a spray tube receptor 1705, and a shaped spray nozzle tip 1707.

FIG. 17B shows a stayed nozzle 1710 with the addition of a nozzle stop 1712 which prevents the spray nozzle tip 1707 from going too deeply through the actuator receptor.

Figure 17F:
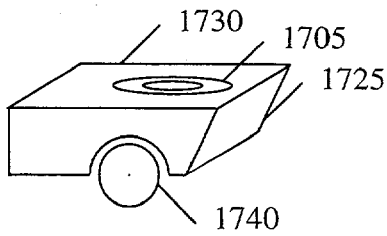
Figure 17G:
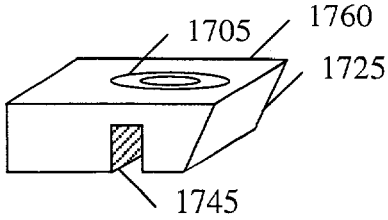
Figure 17H:
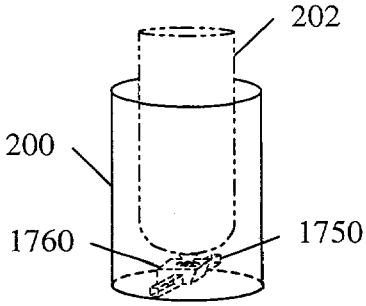

FIG. 17C shows a beveled block nozzle 1720 where the beveled edge 1725 is deflected by a deflector 1740; the deflector 1740 could be the axle 400, the two wheeled axle 720, the container bolt 1330, or another element, depending on the configuration. By rotating the container 202 ninety degrees the block side of the beveled block nozzle 1720 will rest on top of the bolt avoiding deflection. FIG. 17D shows a notched nozzle 1730 with the addition of a notch 1735. FIG. 17E shows the nozzle 1730 in the "on" position against the deflector 1740. FIG. 17F shows the nozzle 1730 in the "off" position against the deflector 1740. FIG. 17G shows a rectangular notched nozzle 1760 with a rectangular notch 1745. FIG. 17H shows the rectangular notched nozzle 1760 being deflected by a rectangular deflector 1750.

Figure 18A:
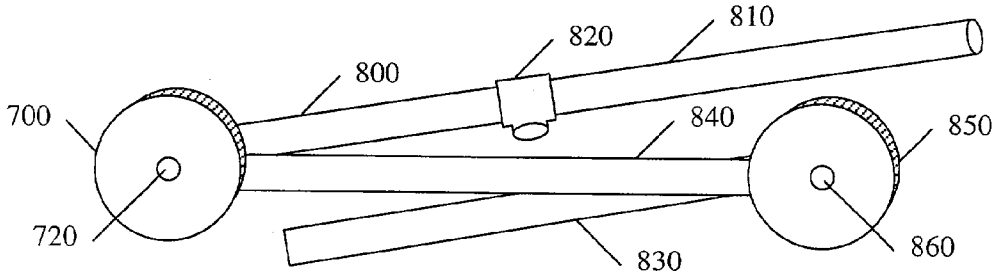
FIGS. 18A through 18C show various structural features.
Figure 18B:
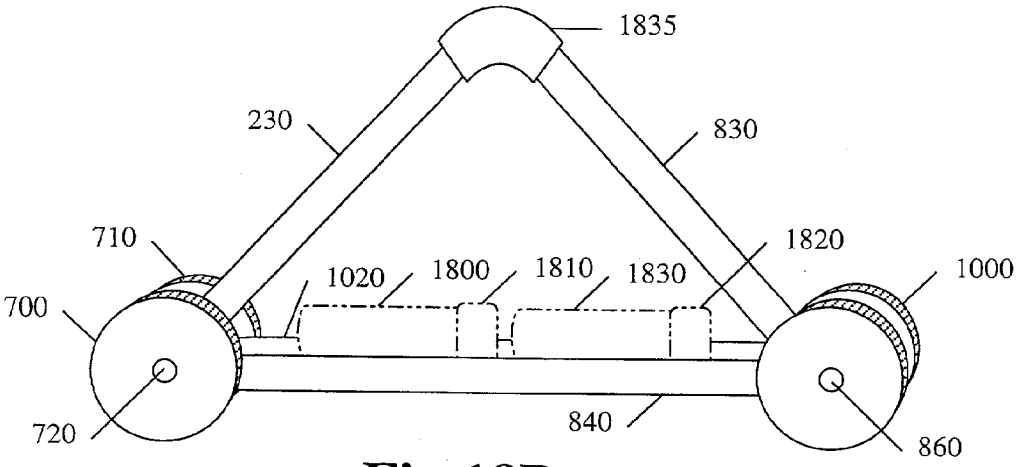
Figure 18C:
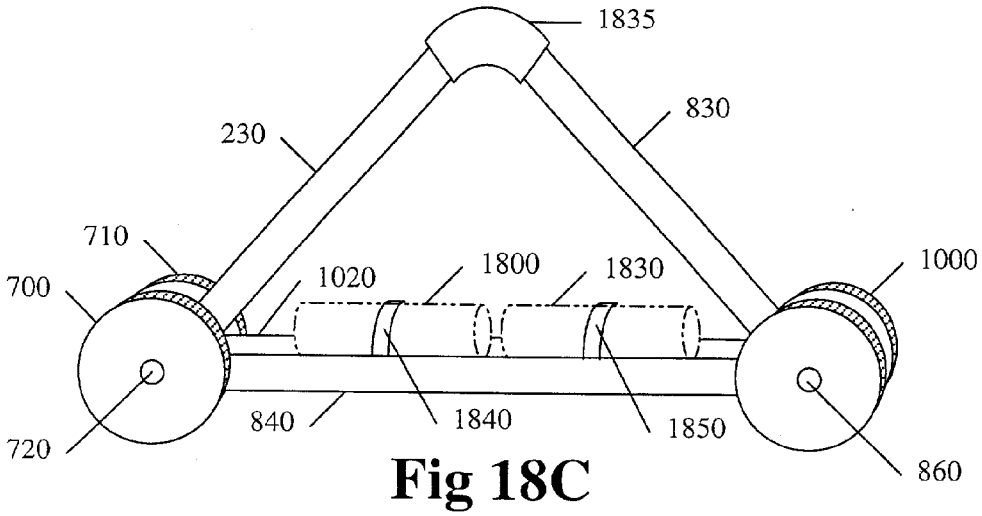

FIGS. 18A through 18C

FIGS. 18A through 18C show various structural features. FIG. 18A shows that the paint striper can be collapsed by disconnecting the third shaft 830 from the 3 way connector 820. Optionally this connection can be held with a removable pin or clasp. The present invention anticipates that any of the connectors that the third shaft 830 connects to could be disconnected in a similar manner.

FIG. 18B shows a first spare container 1800 being held in place by a first lid 1810 and a second spare container 1830 being held in place by a second lid 1820. Each lid is permanently attached to the fourth shaft 840 and the fifth shaft 1020. The spare containers 1800 and 1830 are snapped into the lids 1810 and 1820, respectively.

FIG. 18C shows the spare containers 1800 and 1830 being held in place by a first container fastener 1840 and a second container fastener 1850.

Figure 19A:
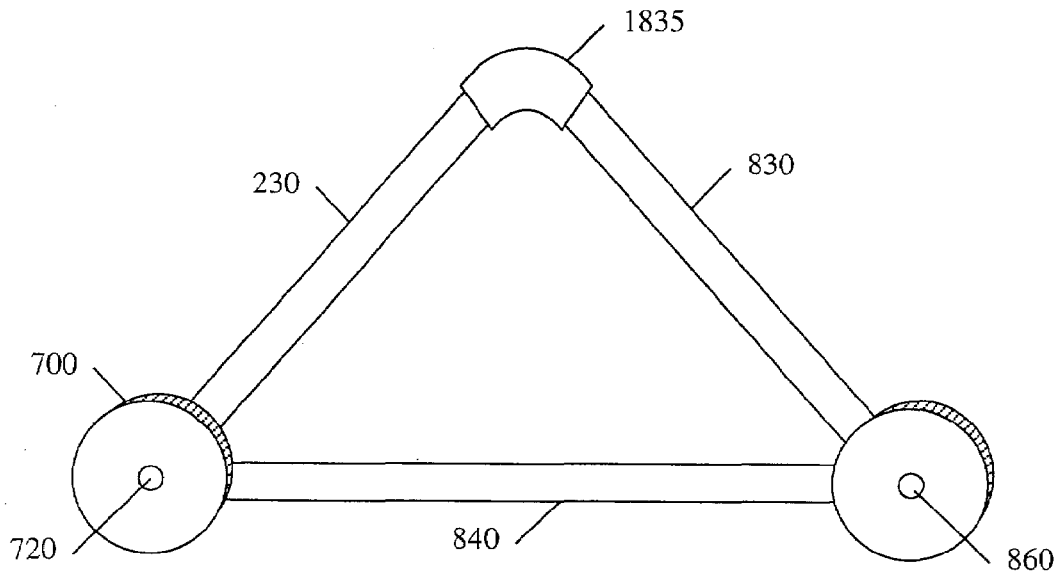
FIGS. 19A through 19B show various structural configurations.
Figure 19B:
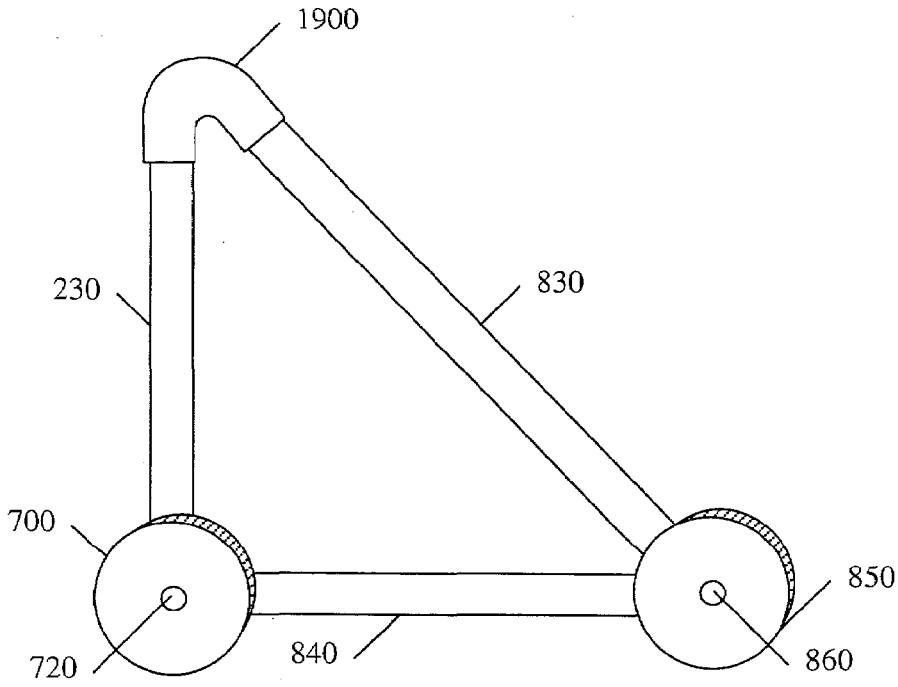

FIGS. 19A and 19B

FIGS. 19A through 19B show various structural configurations that do not require handles and only require one connector. Either the extension 230 or the third shaft 830, can be pushed or pulled and act as a handle. A trigger mechanism can be mounted on one of the shafts. FIG. 19A shows the extension 230 and the third shaft 830 connected with connector 1835. Good results have been obtained using a standard PVC elbow. FIG. 19B shows a version of the connector 1835 with a more acute angle, an acute connector 1900. The acute angle allows the wheel base to be shorter than the configuration in FIG. 19A. The acute angle also allows the shortened container holder 200 (not shown) to be more closely perpendicular to the surface. Both configurations shown in FIGS. 19A and 19B have wide wheel bases and provide straight tracking.

FIG. 20

Figure 20:
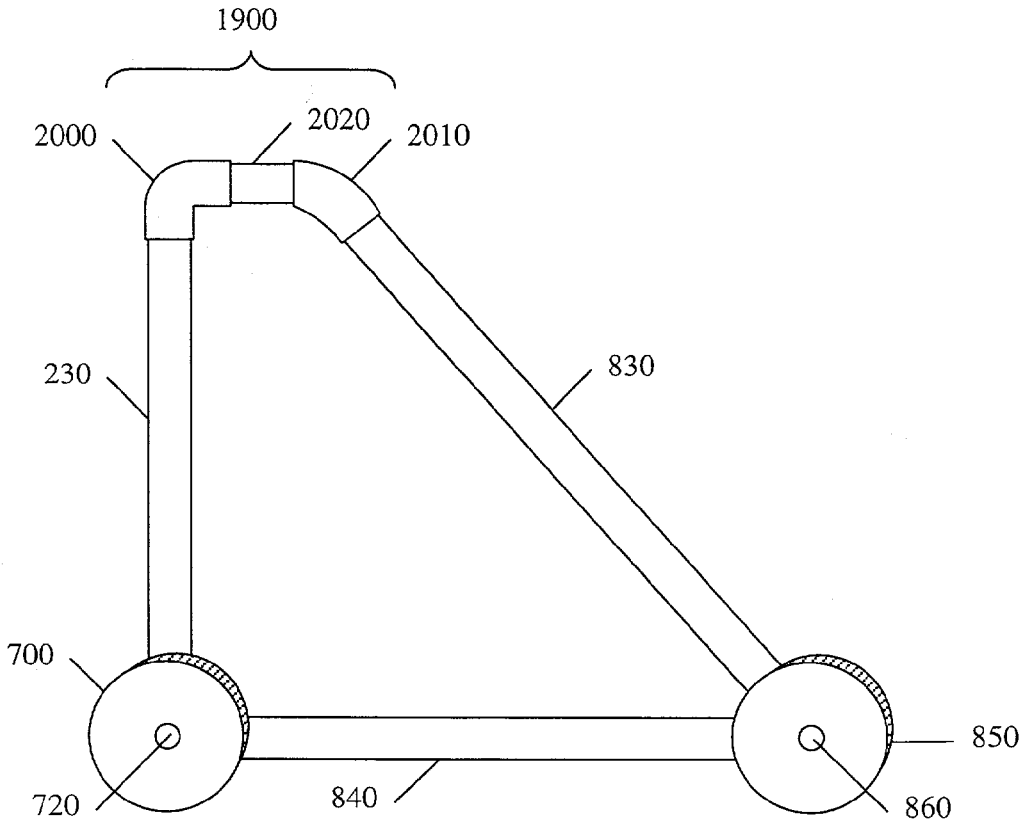
FIG. 20 shows a structural configuration.

FIG. 20 shows another structural configuration similar to FIG. 19B where the acute connector 1900 is comprised of a ninety degree connector 2000, a forty five degree connector 2010, and a connecting shaft 2020.

ADVANTAGES

Readily Available Parts

The present invention is made of readily available materials and parts such as PVC pipe. This allows for just about anyone to be able to build their own paint striper.

Low Cost

The present invention is a low cost paint striper because the components are made of readily available and inexpensive materials. Again, this allows for just about anyone to buy the parts for and build their own paint striper. Not only is the present invention inexpensive to build but also to operate and maintain in working condition.

Transportable

Not only is the present invention lightweight but also can be collapsed making it compact and easy to store and transport. These features are ideal for persons, schools, teams, and clubs wanting an easy to transport paint striper.

User Selection

The present invention has several embodiments of which the operator may choose depending on his or her liking or type of paint striping job that needs to be done. The size of the paint striper may also vary in height depending on the height of the operator, therefore making it possible for persons of almost any age or size to use.

Environment Friendly

Since the present invention does not require the use of gasoline, no fossil fuels will be emitted into the environment.

Straight Tracking

Especially in the embodiments with the long wheel bases, the present invention is capable of straight tracking or paint striping.

Storage of Spare Containers

The present invention allows for extra spray paint cans or such containers (202, 1800, 1830) to be stored on the base of the paint striper. The container remains stationary by fastening the cans on top of and in between the two base members that run parallel to the ground (840 and 1020).

Easy "ON" and "OFF"

The present invention has various embodiments of a paint dispenser mechanism that allows for the operator to easily activate or deactivate the spray nozzle.

Manufacturing

Because the present invention is simple and inexpensive to make, such a product can be easily manufactured. The separate parts of the invention could be sold in kits to be put together by the purchaser. For example boy scouts or youth groups could assemble and sell the kits for a fundraiser. The members or parts of the paint striper could even be painted or decorated with school colors, for example.

CONCLUSION, RAMIFICTION, AND SCOPE

Accordingly, the reader will see that the present invention provides a lightweight, inexpensive paint striper.

While my above descriptions contain several specifics these should not be construed as limitations on the scope of the invention, but rather as examples of some of the preferred embodiments thereof. Many other variations are possible. For example other embodiments of a paint striper include a paint striper in the form of a skateboard or a scooter.

Accordingly, the scope of the invention should be determined not by the embodiments illustrated, but by the appended claims and their legal equivalents.

I claim:

1. A paint striper comprising:

a) a container holder of sufficient size and shape to hold a container, b) a means for actuating a spray, c) a wheel, and d) an axle, wherein said container holder is connected to said means for actuating said spray, wherein said axle passes through and connects said wheel to said container holder, and wherein said axle passes through said container holder and functions as said means for activating said spray, whereby said paint striper will apply said spray to a surface.

2. The paint striper of claim 1 further comprising a handle,
wherein, said handle connects to said container holder whereby said user's ability to maneuver said paint striper is facilitated.

3. The paint striper of claim 2 further comprising an elbow wherein said elbow connects said handle to said container holder.

4. The paint striper of claim 2 further comprising a handle grip,
wherein said handle grip connects to said handle,
whereby said handle grip provides increased control and comfort for said user while operating said paint striper.

5. The paint striper of claim 1 further comprising:
a trigger means, said means comprising:
i) a trigger mechanism, and
ii) a means for conveying force,
wherein said trigger means is connected to said container holder, and
wherein a force applied by said trigger mechanism is transferred through said means for conveying force to a structure selected from the group of
a) means for actuating a spray, and
b) said container,
whereby the trigger means may be used to actuate a spray for a period of time and said paint striper will apply said spray to a surface during said period of activation.

6. The paint striper of claim 5 wherein said trigger mechanism is a shifter and said means for conveying force is a cable,
whereby a user may apply a rotational force to said shifter to actuate said spray.

7. The paint striper of claim 5 wherein said trigger mechanism is a squeeze trigger whereby a user may apply a squeezing force to said squeeze trigger to alter the actuation of said spray.

8. The paint striper of claim 5 wherein said trigger mechanism is a lever trigger, whereby a user may apply a force to the lever trigger to alter the actuation of said spray.

9. A paint striper comprising:
a) a container holder of sufficient size and shape to hold a container,
b) a means for actuating a spray,
c) a shortened container holder, and
d) an extension, comprising:
(i) first shaft,
(ii) a second shaft,
(iii) and a three way connector
e) a third shaft,
f) a fourth shaft,
g) a first wheel,
h) an axle,
i) a rear wheel, and
j) a second axle
wherein said container holder is connected to said means for actuating said spray,
wherein said extension is connected to said shortened container holder, and said shortened container holder mounts to said extension,
wherein said first shaft and said second shaft are connected by said three way connector, and
wherein said three way connector connects to said third shaft,
wherein said axle passes through and connects said first wheel, said container holder, and said fourth shaft,
wherein said second axle passes through and connects said rear wheel, said third shaft, and said fourth shaft,
whereby said paint striper will apply said spray to a surface.

10. The paint striper of claim 9 further comprising
k) a second wheel
wherein said axle passes through and connects to said second wheel.

11. The paint striper of claim 10 further comprising
l) a fourth wheel, and
m) a fifth shaft
wherein said fifth shaft runs parallel to said fourth shaft and connects to said axle, and,
wherein said second axle passes through and connects said fourth wheel and said fifth shaft.

12. The paint striper of claim 9 further comprising
a) plurality of pads,
wherein said pads are attached to said container holder,
whereby said pads keep said container in place.

13. A paint striper for applying a spray to a surface consisting of:
a) a chassis consisting of:
i) a container holder of sufficient size and shape to hold a container,
ii) a plurality of shafts,
iii) at least one connector, said connector having at least two receiving ends for connecting at an angle at least two of said shafts,
b) at least one wheel,
c) at least one axle,
wherein said plurality of shafts are connected to said connector, and
wherein said plurality of shafts are connected to said container holder, and
wherein said chassis is connected to said axle, and
wherein said axle is connected to said wheel,
whereby said paint striper carries said container in a path over said surface.

14. A paint striper for applying a spray to a surface consisting of:
a) a chassis consisting of:
i) a container holder of sufficient size and shape to hold a container,
ii) a plurality of shafts,
iii) at least one connector, said connector having at least two receiving ends for connecting at an angle at least two of said shafts,
b) at least one wheel,
c) at least one axle,
d) a trigger means
wherein said plurality of shafts are connected to said connector,
wherein said plurality of shafts are connected to said container holder,
wherein said chassis is connected to said axle,
wherein said axle is connected to said wheel, and
wherein said trigger means is connected to said chassis,
whereby said paint striper carries said container in a path over said surface, and
whereby said trigger means actuates said spray over portions of said path.

15. A paint striper for applying a spray to a surface comprising:

a) a chassis comprising:

i) a container holder of sufficient size and shape to hold a container, ii) a plurality of shafts, iii) at least one connector, b) at least one wheel, c) at least one axle, wherein said plurality of shafts are connected to said connector, wherein said plurality of shafts are connected to said container holder, wherein said chassis is connected to said axle, wherein said axle is connected to said wheel, wherein said chassis forms a triangle, wherein a first axle passes through and connects a first wheel to the chassis at a first angle of said triangle, wherein a second axle passes through and connects a second wheel to the chassis at a second angle of said triangle, and wherein a third angle of said triangle is formed by two of said shafts connected by said connector, whereby said paint striper carries said container in a path over said surface.

16. The paint striper of claim 15 wherein said connector is comprised of:

a) ninety degree connector, b) a connecting shaft, c) and a forty-five degree connector.

* * * * *